US007696428B2

(12) United States Patent
Konishi

(10) Patent No.: US 7,696,428 B2
(45) Date of Patent: Apr. 13, 2010

(54) ELECTRONIC KEYBOARD MUSICAL INSTRUMENT

(75) Inventor: Keiji Konishi, Shizuoka-ken (JP)

(73) Assignee: Kabushiki Kaisha Kawai Gakki Seisakusho, Shizuoka-Ken (JP)

( * ) Notice: Subject to any disclaimer, the term of this patent is extended or adjusted under 35 U.S.C. 154(b) by 0 days.

(21) Appl. No.: 12/127,122

(22) Filed: May 27, 2008

(65) Prior Publication Data

US 2008/0295668 A1 Dec. 4, 2008

(30) Foreign Application Priority Data

May 28, 2007 (JP) ..... 2007-140514

(51) Int. Cl.
*G10H 1/32* (2006.01)

(52) U.S. Cl. ..... 84/719; 84/174; 84/718; 84/743; 84/744

(58) Field of Classification Search ..... None
See application file for complete search history.

(56) References Cited

U.S. PATENT DOCUMENTS 4,334,453 A 6/1982 Kumano
5,465,644 A 11/1995 Shimoda et al.
2006/0027070 A1 2/2006 Ishihara et al.

FOREIGN PATENT DOCUMENTS

| | | |
|---|---|---|
| JP | 4124293 | 11/1992 |
| JP | 10282950 | 10/1998 |
| JP | 2000148146 | 5/2000 |
| JP | 2002062874 | 2/2002 |

*Primary Examiner*—Marlon T Fletcher
(74) *Attorney, Agent, or Firm*—Davis & Bujold, P.L.L.C.

(57) ABSTRACT

An electronic keyboard musical instrument includes a body unit of the musical instrument and a stand attached to the body unit. The stand includes a pair of side boards disposed in a standing manner so as to interpose the body unit therebetween. The body unit includes a pair of lateral surfaces. Each of the pair of lateral surfaces faces one of the pair of side boards and includes a first engaging portion disposed thereon. Each of the pair of side boards includes a first engaged portion engaged by the first engaging portion and disposed on an inner lateral surface thereof, which faces one of the pair of lateral surfaces of the body unit. The first engaging portion and the first engaged portion are engaged with each other by at least one of the body unit and the stand being moved in a predetermined direction.

12 Claims, 9 Drawing Sheets

ELECTRONIC KEYBOARD MUSICAL INSTRUMENT

CROSS-REFERENCE TO RELATED APPLICATION

This application claims the benefit of Japanese Patent Application No. 2007-140514 filed May 28, 2007 in the Japan Patent Office, the disclosure of which is incorporated herein by reference.

BACKGROUND

This invention relates to an electronic keyboard musical instrument, such as an electronic piano and the like, in which a body unit of the musical instrument is attached to a stand.

Some type of an electronic keyboard musical instrument has been conventionally proposed wherein a stand is formed by disposing side panels in a standing manner on left and right toe blocks, and a pedal base between the toe blocks, the body unit of the musical instrument is placed on the top ends of the side panels of the stand, and side boards are attached by hook-and-loop fasteners and the like to the lateral surfaces of the body unit and the side panels (see, for example, Unexamined Japanese Patent Publication No. 2000-148146).

Another type of electronic keyboard musical instrument has been also known wherein metal attachments are disposed on the top ends of the left and the right side panels, and hooks are provided on the bottom surface of the body unit of the musical instrument for preventing falls (see, for example, Paragraphs 0004, 0005, and FIG. 5 of Unexamined Japanese Patent Publication No. 2002-62874). This type of electronic keyboard musical instrument is configured such that, when the body unit is placed on the top ends of the side panels for an attachment purpose, the body unit of the musical instrument is engaged by the hooks with the metal attachments, provided on the top ends of the left and the right side panels, and inhibited from falling until the body unit is secured to the side panels by using nuts and the like.

In the electronic keyboard musical instrument disclosed by Unexamined Japanese Patent Publication No. 2000-148146, the side boards can be easily attached by using hook-and-loop fasteners. However, there has been a problem in that the number of the components becomes large and the structure becomes complicated, because the structure of the musical instrument requires the left and the right side panels and the left and the right side boards, and the left and the right side boards need to be attached by the hook-and-loop fasteners. Moreover, there has been a problem, from the perspective of the design, that the configuration of the side boards becomes complicated, if the cross-sectional shape of the side boards should be made into approximately an angulated U-shape so that the side boards can cover not only the lateral surfaces of the side panels, but also the front and the rear surfaces of the side panels.

Moreover, in the electronic keyboard musical instrument disclosed by Unexamined Japanese Patent Publication No. 2002-62874, there has been a problem in that providing the hooks, which are used only to prevent falls during assembly, causes an increase in the number of components. In addition, there has been other problems in that packaging of the body unit for a transportation purpose is cumbersome, because the hooks protrude from the bottom surface of the body unit of the musical instrument, and that misengagement of the hooks is likely to be caused, because the disposition of the hooks on the bottom surface of the body unit makes it difficult to check whether or not the hooks have been properly engaged with the metal attachments.

SUMMARY

In consideration of the above-described and other problems, an electronic keyboard musical instrument is preferably configured such that the body unit of the musical instrument can be easily supported by a stand by using a small number of components and a simple structure.

One aspect of the present invention provides an electronic keyboard musical instrument including a body unit of the musical instrument and a stand attached to the body unit. The stand includes a pair of side boards disposed in a standing manner so as to interpose the body unit therebetween. The body unit includes a pair of lateral surfaces. Each of the pair of lateral surfaces faces one of the pair of side boards and includes a first engaging portion disposed thereon. Each of the pair of side boards includes a first engaged portion engaged by the first engaging portion and disposed on an inner lateral surface thereof, which faces one of the pair of lateral surfaces of the body unit. The first engaging portion and the first engaged portion are engaged with each other by at least one of the body unit and the stand being moved in a predetermined direction.

By the electronic keyboard musical instrument configured as above, an effect can be achieved in the respect that the body unit can be supported by the stand with a small number of components and a simple structure, because the body unit and the stand are engaged by an engagement of the first engaged portions of the side boards and the first engaging portions of the body unit.

The first engaged portion may be a guide groove formed so as to extend in the predetermined direction. In this way, the body unit can be easily supported by the stand by inserting the body unit into the guide grooves. Moreover, an end portion of the guide groove, from which the first engaging portion is inserted, may be chamfered. Insertion becomes easier by forming chamfered portions. Furthermore, the predetermined direction may be a horizontal direction.

The guide groove may be formed such that one end thereof is open and another end is closed. Moreover, the pair of side boards may be disposed so as to interpose the body unit from an alignment direction of keys of a keyboard. The pair of lateral surfaces of the body unit may be outer surfaces of the keyboard in the alignment direction.

The first engaging portion may be a protruding portion that protrudes from each of the lateral surfaces of the body unit. A chamfered portion may be formed on a distal end of the protruding portion. If the chamfered portions are provided to the protruding portions and the protruding portions are inserted into the guide grooves, the protruding portions can be smoothly inserted and assembling of the body unit and the stand can be easily done.

The body unit may include second engaging portions, each of which is engaged with one of the pair of side boards, when the first engaging portion and the first engaged portion are engaged. Each of the pair of side boards may include a second engaged portion engaged with one of the second engaging portions. In this case, one of the second engaging portion and the second engaged portion may be a projection that protrudes in a standing direction of the pair of side boards. One of the second engaging portion and the second engaged portion which is not the projection may be a restriction groove with which the projection is engaged. Moreover, each of the second engaging portions may be provided to the first engaging portion. Furthermore, the second engaged portion may be provided to the first engaged portion.

The first engaged portion may be a guide groove formed so as to extend in the predetermined direction. Moreover, one of the body unit and the pair of side boards may be provided with projections protruding in a standing direction of the pair of side boards, and another is provided with restriction grooves adopted such that the projections are engaged therewith. Furthermore, each of the projections may be engaged with one of the restriction grooves, when the first engaging portion is engaged with the guide groove. Due to the above-described configuration, the distance between the pair of side boards can be inhibited from becoming wider, because the projections are engaged with restriction grooves when the first engaging portions are engaged with the guide grooves.

In this case, the first engaging portion may be a protruding portion protruding from each of the pair of lateral surfaces of the body unit. Moreover, each of the restriction grooves may be disposed inside of the guide groove, and each of the projections may be disposed on the protruding portion.

A member disposed in the body unit may be secured to the first engaging portion by screws. Moreover, the screws that secure the member disposed in the body unit may be inserted into the protruding portions from outside of the body unit. In this way, the screws can be easily accessed, which, in turn, makes screw fixing easy.

BRIEF DESCRIPTION OF THE DRAWINGS

The invention will now be described below, by way of example, with reference to the accompanying drawings, in which.

DETAILED DESCRIPTION OF THE PREFERRED EMBODIMENT

Figure 1:
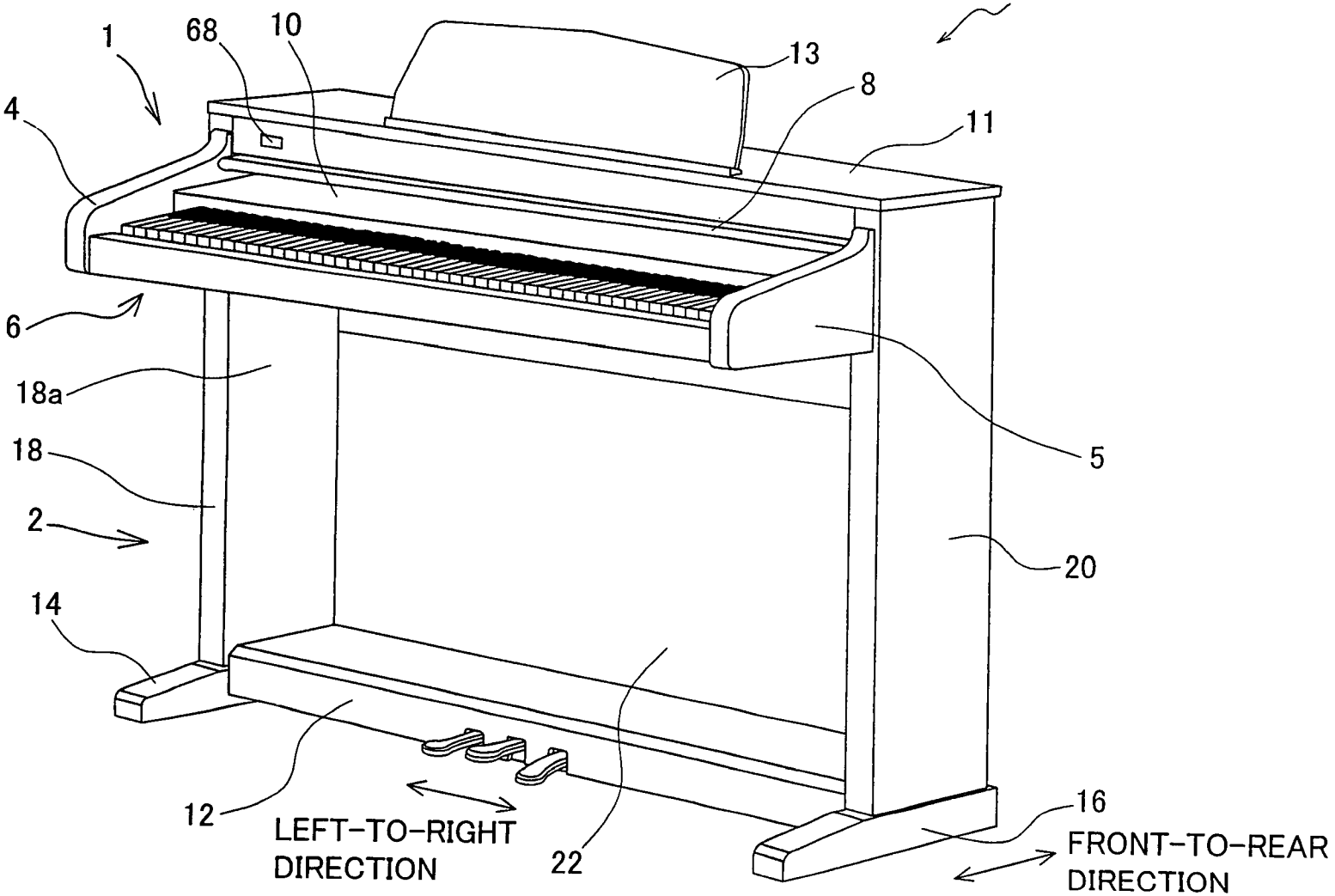
FIG. 1 is a perspective view showing an electronic keyboard musical instrument according to an embodiment of the present invention.

As shown in FIG. 1, an electronic keyboard musical instrument 3 according to an embodiment of the present invention includes a body unit 1 and a stand 2 that supports the body unit 1. The stand 2 is configured so as to be a knockdown stand. The body unit 1 includes a pair of left arm 4 and right arm 5, respectively disposed in the left and the right sides of the body unit 1, a keyboard unit 6, interposed between the arms 4, 5, and a keyboard cover 8 that is opened/closed above the keyboard unit 6 in a sliding manner. In the electronic keyboard musical instrument 3 which is an electronic piano and the like, an operational panel 10 is provided in the rear portion of the keyboard unit 6. The body unit 1 also includes, in the top side thereof, a top board 11 on which a foldable music desk 13 is disposed.

The stand 2 includes a pedal base 12, left and right toe blocks 14, 16, disposed in the both sides of the pedal base 12, and left and right side boards 18, 20 disposed on the toe blocks 14, 16 in a standing manner. In the rear side of the side boards 18, 20, a rear board 22 is disposed so as to extend between the side boards 18, 20. It is to be noted that a player of the electronic keyboard musical instrument 3 faces the keyboard unit 6 when he/she plays the instrument 3, and that the side of the electronic musical instrument 3 near to the player is described as the front side of the instrument 3, and the opposite side of the instrument 3 is described as the rear side. Moreover, the alignment direction of keys of the keyboard is described as the left-to-right direction, in which the left side and the right side of the player who is facing the keyboard unit 6 are respectively referred to as the left side and the right side.

Figure 2:
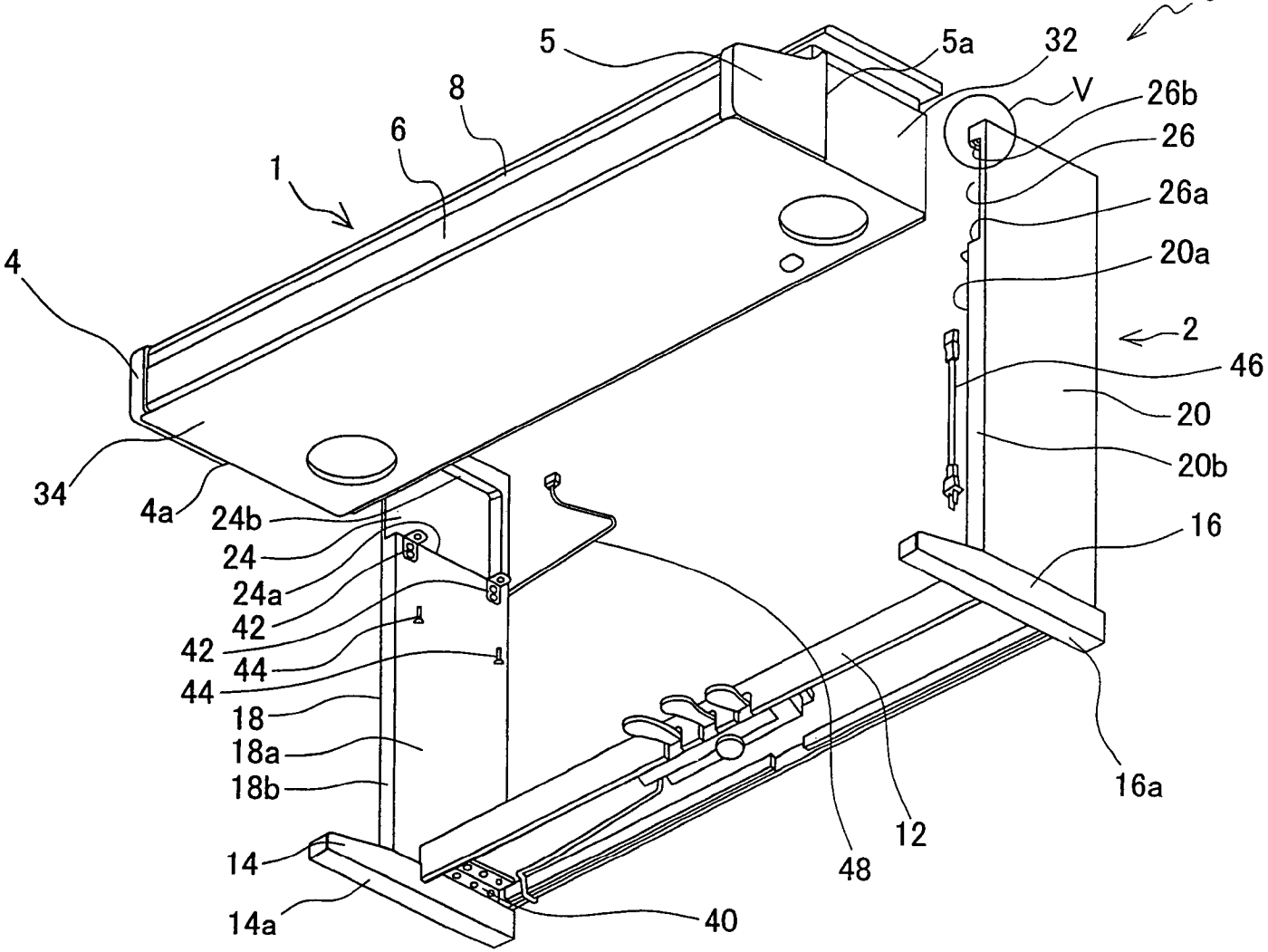
FIG. 2 is an exploded perspective view showing the electronic keyboard musical instrument according to the embodiment, from an obliquely downward direction to an obliquely upward direction, wherein a body unit of the musical instrument and a stand are separated, and the body unit is in a state in which a keyboard unit is covered by a keyboard cover.
Figure 3:
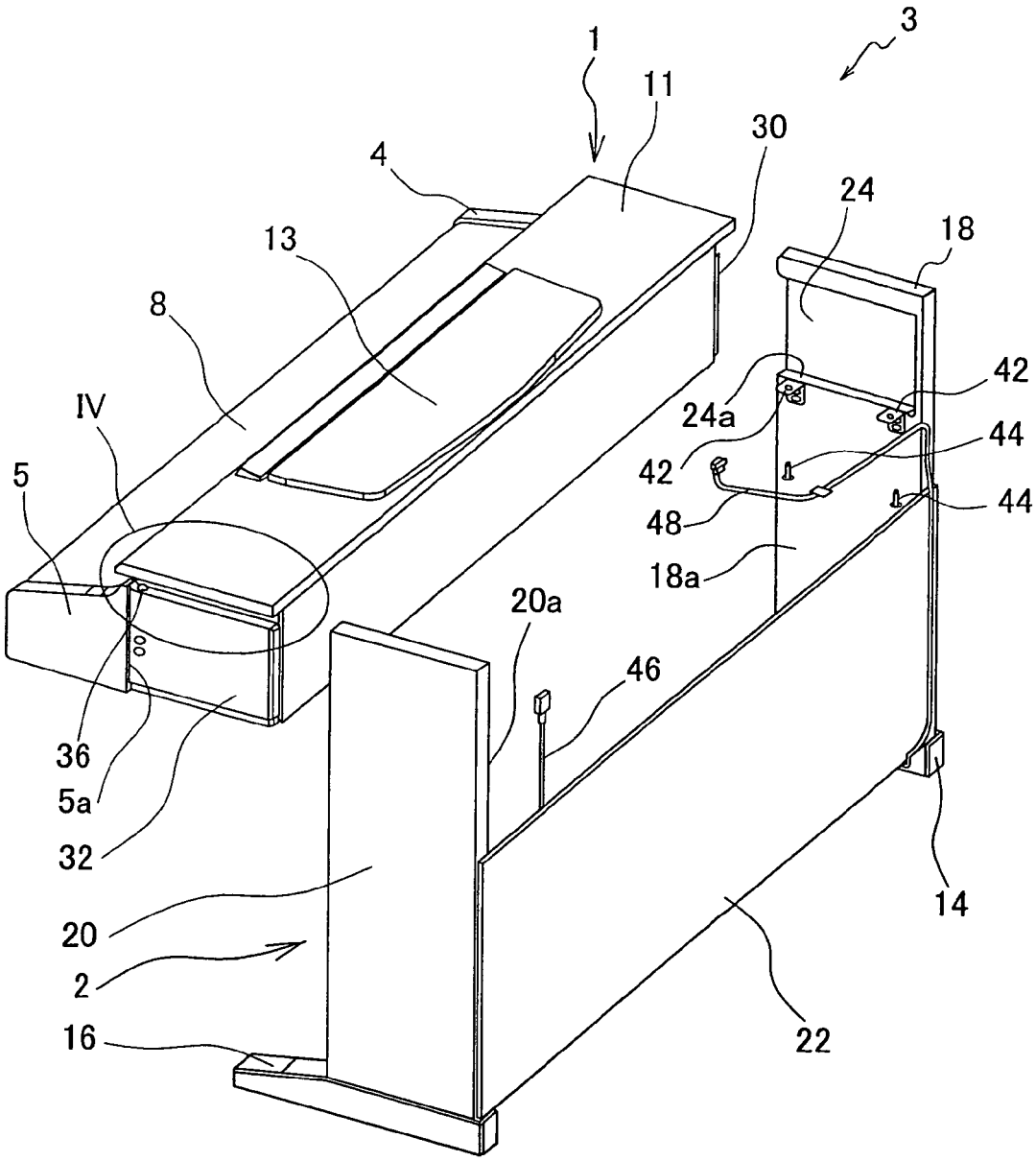
FIG. 3 is an exploded perspective view showing the electronic keyboard musical instrument according to the embodiment, from the obliquely upward direction to the obliquely downward direction, wherein the body unit of the musical instrument and the stand are separated, and the body unit is in the state in which the keyboard unit is covered by the keyboard cover.

As shown in FIGS. 2 and 3, the left and the right side boards 18, 20 are formed in a flat-board shape. The left and the right side boards 18, 20 are respectively disposed on the left and the right toe blocks 14, 16 in the standing manner, and disposed in parallel so that the flat-board shaped side boards 18, 20 face each other.

Inner surfaces 18*a*, 20*a* of the left and the right side boards 18, 20, which face each other, are respectively provided with guide grooves 24, 26. The guide grooves 24, 26 are opened on front surface 18*b*, 20*b* of the side boards 18, 20, and formed so as to extend rearward from the front surfaces 18*b*, 20*b*.

The guide grooves 24, 26 are formed, in the present embodiment, approximately in a rectangle shape, which is long in the front-to-rear direction. Moreover, the guide grooves 24, 26 are formed such that bottom surfaces 14*a*, 16*a* of the left and the right toe blocks 14, 16 and bottom surfaces 24*a*, 26*a* of the guide grooves 24, 26 are disposed respectively parallel to each other.

On both of the left end and the right end of the body unit 1, rectangle-shaped protruding portions 30, 32, protruding in the left-to-right direction, are respectively disposed. The protruding portions 30, 32 are formed so as to be insertable into the above-described guide grooves 24, 26. The rectangle-shaped protruding portions 30, 32 are formed, in the present embodiment, by the arms 4, 5 and the bottom board 34 of the body unit 1 which extends up to the bottom surfaces of the arms 4, 5. The protruding portions 30, 32 are formed in the rear portions of the arms 4, 5. When the protruding portions 30, 32 are inserted into the guide grooves 24, 26, the bottom board 34 contacts the bottom surfaces 24*a*, 26*a* of the guide grooves 24, 26.

Gaps are respectively formed between the top surfaces of the protruding portions 30, 32 and the top board 11. The top board 11 is formed so as to have a length in the left-to-right direction approximately equivalent to the distance between the outer surfaces of the side boards 18, 20. Moreover, the top board 11 is formed so as to have a width in the front-to-rear direction approximately equivalent to the width of the side boards 18, 20 in the front-to-rear direction.

Between the front portions and the rear portions of the arms 4, 5, step portions 4*a*, 5*a* are respectively formed. The front portions of the arms 4, 5 protrude toward the exterior side in the left-to-right direction and upward further than the protruding portions 30, 32. The distance in the left-to-right direction between the outer surfaces of the front portions of the arms 4, 5 is determined slightly smaller than the distance in the left-to-right direction between the outer surfaces of the side boards 18, 20. Therefore, when the protruding portions 30, 32 are inserted into the guide grooves 24, 26, the left and the right side boards 18, 20 protrude toward the exterior side in the left-to-right direction further than the arms 4, 5.

Figure 4:
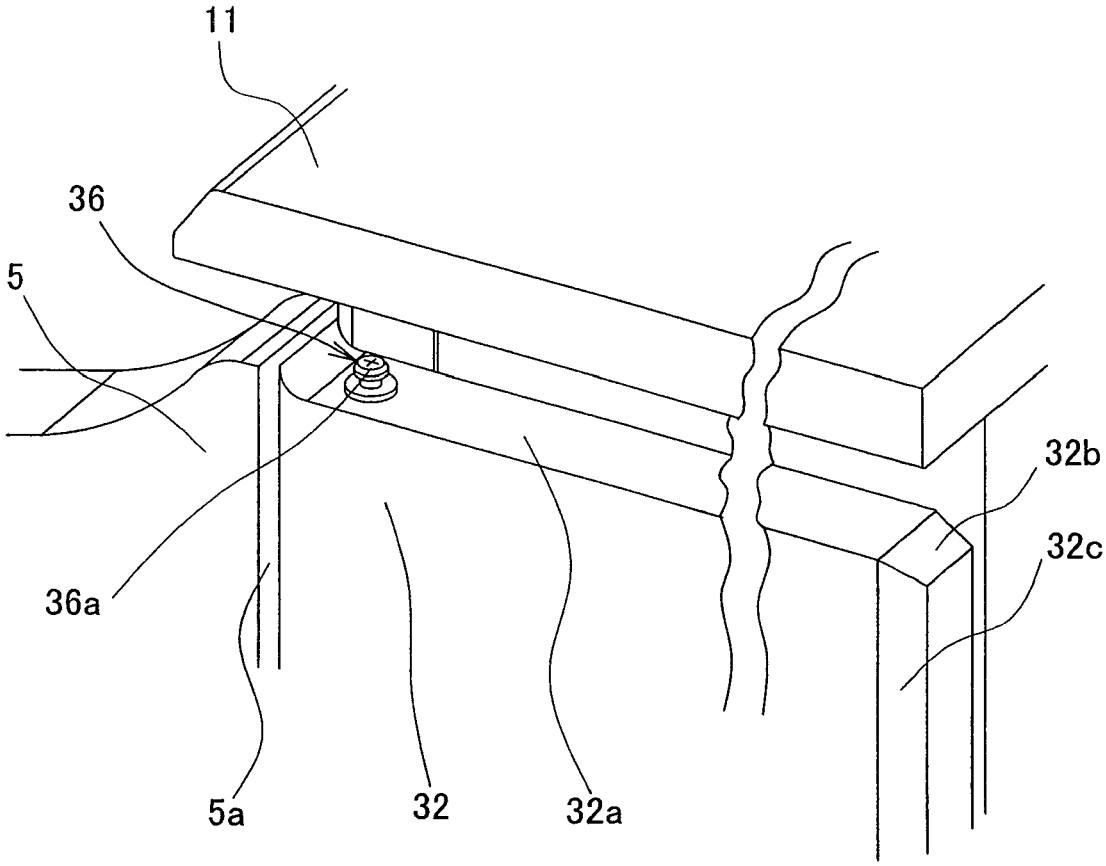
FIG. 4 is an enlarged perspective view of a portion IV shown in FIG. 3.

As shown in FIG. 4, the right protruding portion 32 is provided with a projection 36 projecting in the direction in which the right side board 20 is standing (in the up-and-down direction). The projection 36 is formed, in the present embodiment, in a bolt-like shape having a round head portion 36*a*, and is threadingly fastened to the protruding portion 32. Moreover, the projection 36 is disposed on the top surface 32*a* of the protruding portion 32, and in vicinity of the step portion 5*a* of the arm 5. Although the drawing does not show, a similar projection is also provided to the left protruding portion 30.

As shown in FIGS. 3 and 4, chamfered portions 32*b*, 32*c* are formed at the top corner and the lateral corner of the rear end portion of the protruding portion 32. The bottom corner of the bottom board 34 is not chamfered. The chamfered portions 32*b*, 32*c* can be formed in any size as long as the protruding portion 32 can be easily inserted into the guide groove 26. Moreover, the other protruding portion 30 is also chamfered in the same manner. Instead of chamfer processing, fillet processing may be alternatively used.

Figure 5:
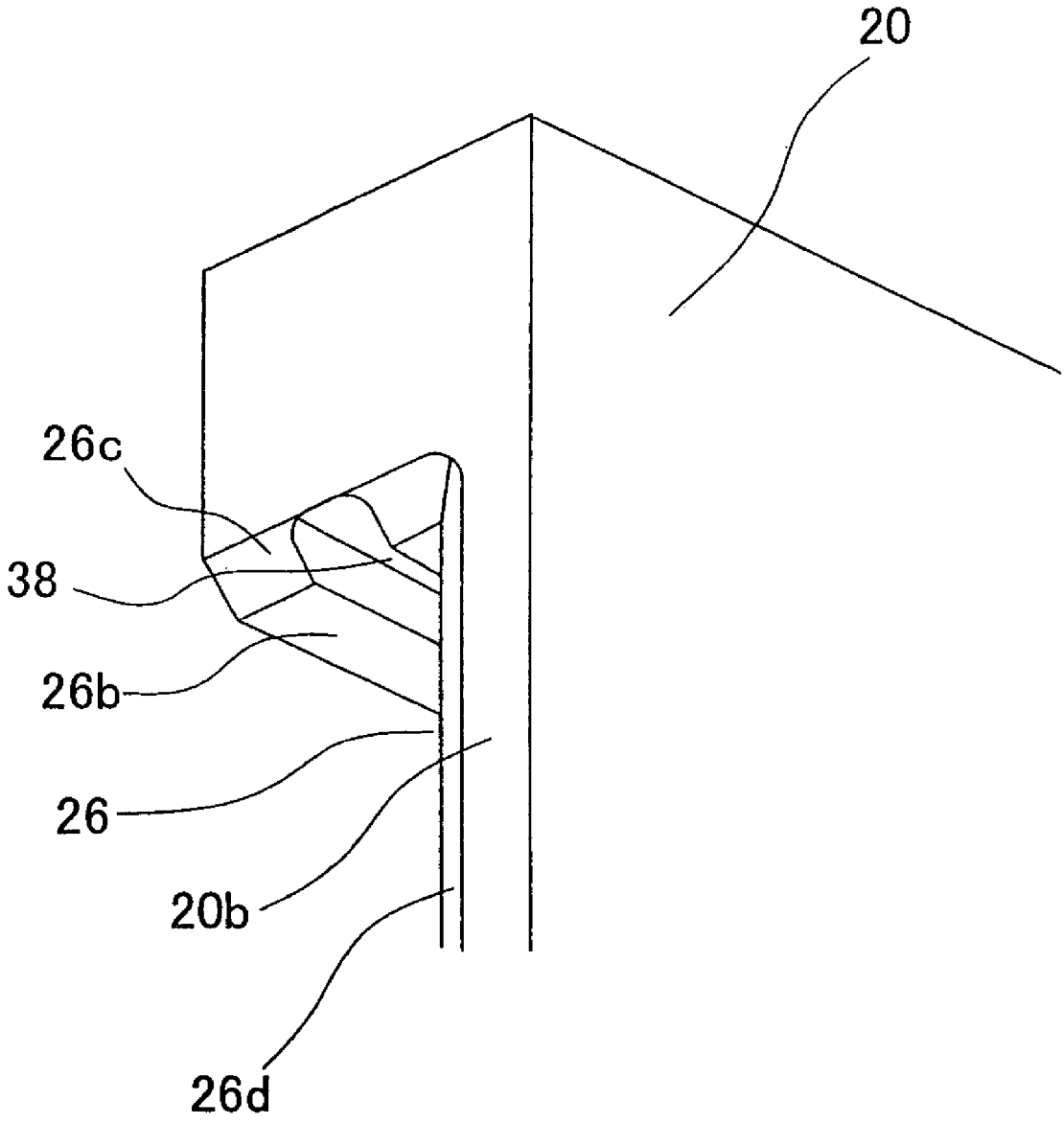
FIG. 5 is an enlarged perspective view of a portion V shown in FIG. 2.

As shown in FIG. 5, the right side board 20 is provided with a restriction groove 38, with which the projection 36 can be engaged. The restriction groove 38 is formed by hollowing the top surface 26*b* of the guide groove 26 so as to be opened inside of the guide groove 26, and formed so as to extend from the front surface 20*b* of the right side board 20 toward the rear direction. The restriction groove 38 can be formed so as to have a length, from the front surface 20*b* of the right side board 20 toward the rear direction, slightly longer than the distance from the step portion 5*a* of the arm 5 to the rear end of the projection 36.

It is to be noted that, instead of disposing the projection 36 on the protruding portion 32, and the restriction groove 38 inside of the guide groove 26, the configuration may alternatively be such that the projection 36 is disposed so as to project downward from the top board 11, and the restriction groove 38 is disposed on to top surface of the right side board 20 so that the projection 36 can be engaged with the restriction groove 38. Additionally, although the drawing does not show, a similar restriction groove is formed on the left side board 18.

As shown in FIG. 5, chamfered portions 26*c*, 26*d* are formed at the top corner and the lateral corner of the open end of the guide groove 26, which is opened in the front surface 20*b* of the right side board 20. As shown in FIG. 2, no chamfered portion is provided to the bottom corner of the open end of the guide groove 26. The chamfered portions 26*c*, 26*d* are formed so as to have a size smaller than the size of the step portion 5*a* of the arm 5 so that, when the protruding portion 32 is inserted into the guide groove 26, the chamfered portions 26*c*, 26*d* are hidden by the step portion 5*a* of the arm 5 and become externally invisible. Moreover, similar chamfered portions are provided to the other guide groove 24. In addition, instead of the chamfer processing, the fillet processing may be alternatively used.

Figure 6:
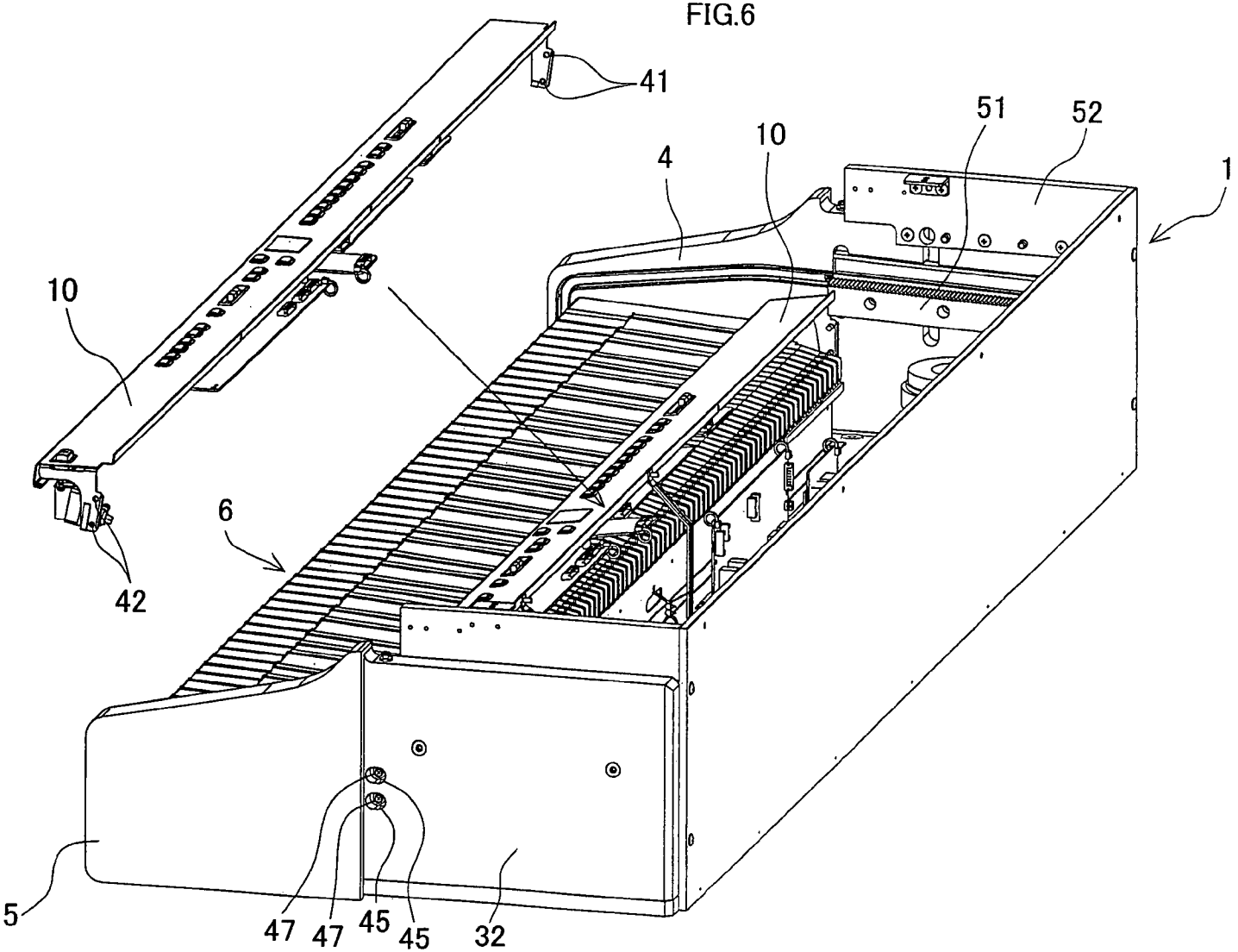
FIG. 6 is an enlarged perspective view showing the body unit of the electronic keyboard musical instrument according to the embodiment in a state wherein the keyboard cover and a top board are removed from the body unit.

As shown in FIG. 6, the above-mentioned operational panel 10 is formed so as to have a width in the left-to-right direction approximately equivalent to the distance between the inner surfaces of the arms 4, 5. On the left and the right end surfaces of the operational panel 10, threaded holes 41, 42 are respectively formed.

The operational panel 10 is inserted between the arms 4, 5, and the left and the right end surfaces of the operational panel 10 contact with the inner surfaces of the arms 4, 5. In the respective protruding portions 30, 32 of the arms 4, 5, spot-facing holes 44, 45 (see FIGS. 6 and 7), which are associated with the threaded holes 41, 42, are formed. The spot-facing holes 44, 45 are formed such that screws 47 are inserted therein from the exterior sides of the respective arms 4, 5 (only the screws 47 inserted from the arm 5 are shown). The screws 47 are respectively inserted into the spot-facing holes 44, 45, and threadingly inserted into the threaded holes 41, 42 of the operational panel 10 so as to secure the operational panel 10 to the left and the right arms 4, 5. If screws 47 are threadingly inserted from the interior sides of the respective arms 4, 5, assembling needs to be done in a narrow space, that is, a screw driver has to be handled between the left and the right arms 4, 5, which makes the assembling uneasy. However, in the present embodiment, assembling can be easily done, because the screws 47 can be threadingly inserted from the exterior sides of the respective arms 4,5.

The following describes an assembling procedure of the body unit 1 and the stand 2 according to the present embodiment.

Firstly, the left and the right toe blocks 14, 16 are attached to the left and the right side boards 18, 20. To the side boards 18, 20, the pedal base 12 is attached by using metal plates 40 (only one metal plate 40 is shown, see FIG. 2). Then, the rear board 22 is attached in the rear side of the left and the right side boards 18, 20. As a result, the stand 2 is assembled.

Subsequently, the protruding portions 30, 32 provided on both sides (left side and right side) of the body unit 1 are inserted into the guide grooves 24, 26 of the side boards 18, 20. The insertion may be done, while the stand 2 is held in a standing manner, by moving the body unit 1 in the front-to-rear direction (in the horizontal direction) and inserting the protruding portions 30, 32 into the guide grooves 24, 26. Alternatively, the insertion may be done, while the stand 2 is laid down on a floor such that the rear board 22 lies on the floor surface, by rotating the body unit 1 by 90 degrees and moving the rotated body unit 1 downward so as to insert the protruding portions 30, 32 into the guide grooves 24, 26.

As the protruding portions 30, 32 are inserted along the guide grooves 24, 26, the projections 36 are also engaged with the restriction grooves 38. When the step portions 4*a*, 5*a* of the arms 4, 5 touch the front surfaces 18*b*, 20*b* of the side boards 18, 20, any further insertion is restricted.

After the insertion, the bottom board 34 of the body unit 1 and the side boards 18, 20 are secured by L-shaped metal plates 42 (only some of the metal plates 42 are shown, see FIG. 3) and screws 44. One of the plate portions of the respective L-shaped metal plates 42 contact with the bottom surface of the bottom board 34, and the other plate portions of the respective L-shaped metal plates 42 contact with the inner surfaces 18*a*, 20*a* of the side boards 18, 20. Subsequently, a power supply cord 46 and a pedal cord 48 are connected.

In the electronic keyboard musical instrument 3 according to the present embodiment, by inserting the protruding portions 30, 32 provided on both sides of the body unit 1 into the guide grooves 24, 26 of the side boards 18, 20, the body unit 1 can be supported by the stand 2. Moreover, the stand 2 has a simple configuration wherein the side boards 18, 20 respectively stand on the toe blocks 14, 16. Therefore, in the electronic keyboard musical instrument 3 according to the present embodiment, the number of components can be reduced, as compared to the number of components used in conventional electronic keyboard musical instruments.

Since the protruding portions 30, 32 provided on both sides of the body unit 1 are inserted into the guide grooves 24, 26 of the side boards 18, 20, the body unit 1 is supported by the stand 2 and does not fall even before the body unit 1 is threadingly secured by using the L-shaped metal plates 42, which, as a result, enables safe assembling. Moreover, since additional members, such as hooks, do not need to be provided to the bottom surface, or other surfaces of the body unit 1, the shape of a packaging box for the body unit 1 can be simple, and packaging can be easily done. Furthermore, an accidental damage on a floor surface, which can be caused by such hooks and the like, can be avoided.

Moreover, in the front view of the electronic keyboard musical instrument 3, the configuration of the instrument 3 is such that the side boards 18, 20 enclose the arms 4, 5 of the body unit 1 in a manner as if angulated U-shapes are laid sideways. An expensive looking in view of design can be achieved by such configuration. Furthermore, even if some portions of the front surfaces 18*b*, 20*b* of the side boards 18, 20 around the guide grooves 24, 26 are scratched when the protruding portions 30, 32 are inserted into the guide grooves 24, 26, the front surfaces 18*b*, 20*b* are hidden by the step portions 4*a*, 5*a* of the arms 4, 5. Therefore, a presentable appearance of the electronic keyboard musical instrument 3 is not lost.

Furthermore, some portions of the corners at the rear ends of the protruding portions 30, 32 are provided with chamfered portions 32*b*, 32*c* (only the chamfered portions 32*b*, 32*c* of the protruding portion 32 are shown), and some portions of the corners at the open ends of the guide grooves 24, 26 are provided with the chamfered portions 26*c*, 26*d* (only the chamfered portions 26*c*, 26*d* of the guide groove 26 are shown). The chamfered portions 32*b*, 32*c*, 26*c*, 26*d* can make it easy to insert the protruding portions 30, 32 into the guide grooves 24, 26.

The bottom corners at the open ends of the guide grooves 24, 26 and the bottom corners at the rear ends of the protruding portions 30, 32 are not provided with chamfered portions. If chamfered portions are provided to the bottom corners, insertion becomes rather difficult and the chamfered portions are likely to be scratched, because the body unit 1 has to be inserted in a lifted manner so as to be inserted along the chamfered portions. In order to avoid such disadvantages, chamfered portions are not provided to the bottom corners. Even though the chamfered portions 26*c*, 26*d* are provided to the guide grooves 24, 26, the presentable appearance is not lost, because the chamfered portions 26*c*, 26*d* are hidden by the step portions 4*a*, 5*a* of the arms 4, 5.

Moreover, when the protruding portions 30, 32 are inserted into the guide grooves 24, 26, the left and the right projections 36 (only one of the projections 36 is shown) are simultaneously engaged with the left and the right restriction grooves 38 (only one of the restriction grooves 38 is shown).

Since the left and the right projections 36 are engaged with the left and the right restriction grooves 38, the side boards 18, 20 are restricted from opening outward in the left-to-right direction. Therefore, when the weighty body unit 1 is supported by the stand 2, or when the side boards 18, 20 contain moisture, distortion of the side boards 18, 20 can be prevented, and the side boards 18, 20 can be inhibited from opening respectively rightward and leftward.

Moreover, since the protruding portions 30, 32 are inserted into the guide grooves 24, 26, the protruding portions 30, 32 are hidden by the side boards 18, 20. Therefore, even if heads of the screws 47 are exposed on the surfaces of the protruding portions 30, 32, the heads of the screws 47 can be hidden by the side boards 18, 20 when assembling is done, and the presentable appearance of the electronic keyboard musical instrument 3 is not lost.

The following describes the internal structure of the body unit 1 of the electronic keyboard musical instrument 3 according to the present embodiment.

Figure 7:
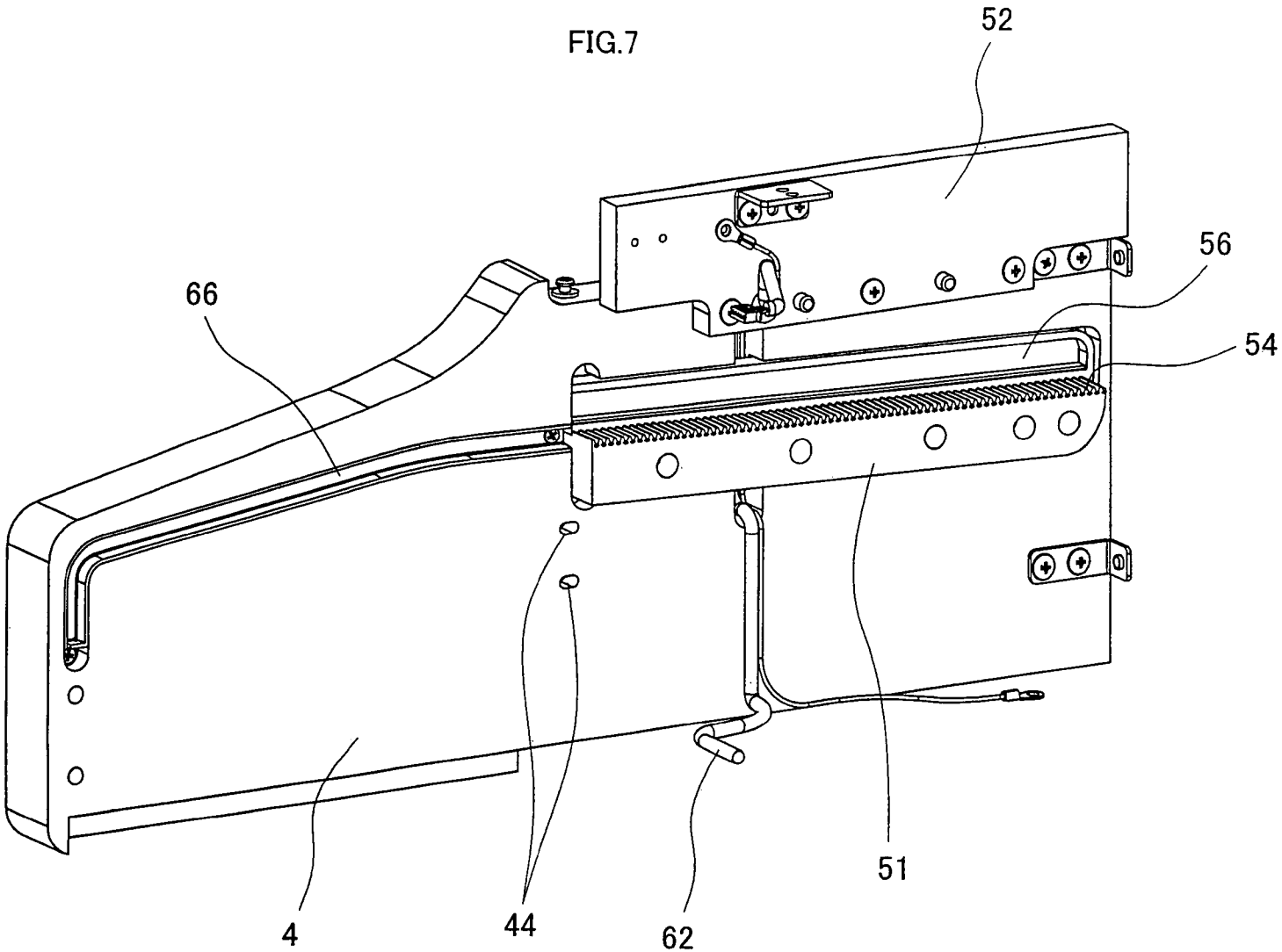
FIG. 7 is an enlarged perspective view of a left arm of the electronic keyboard musical instrument according to the embodiment in a state wherein a rack board and an attachment piece are attached to the arm.
Figure 8:
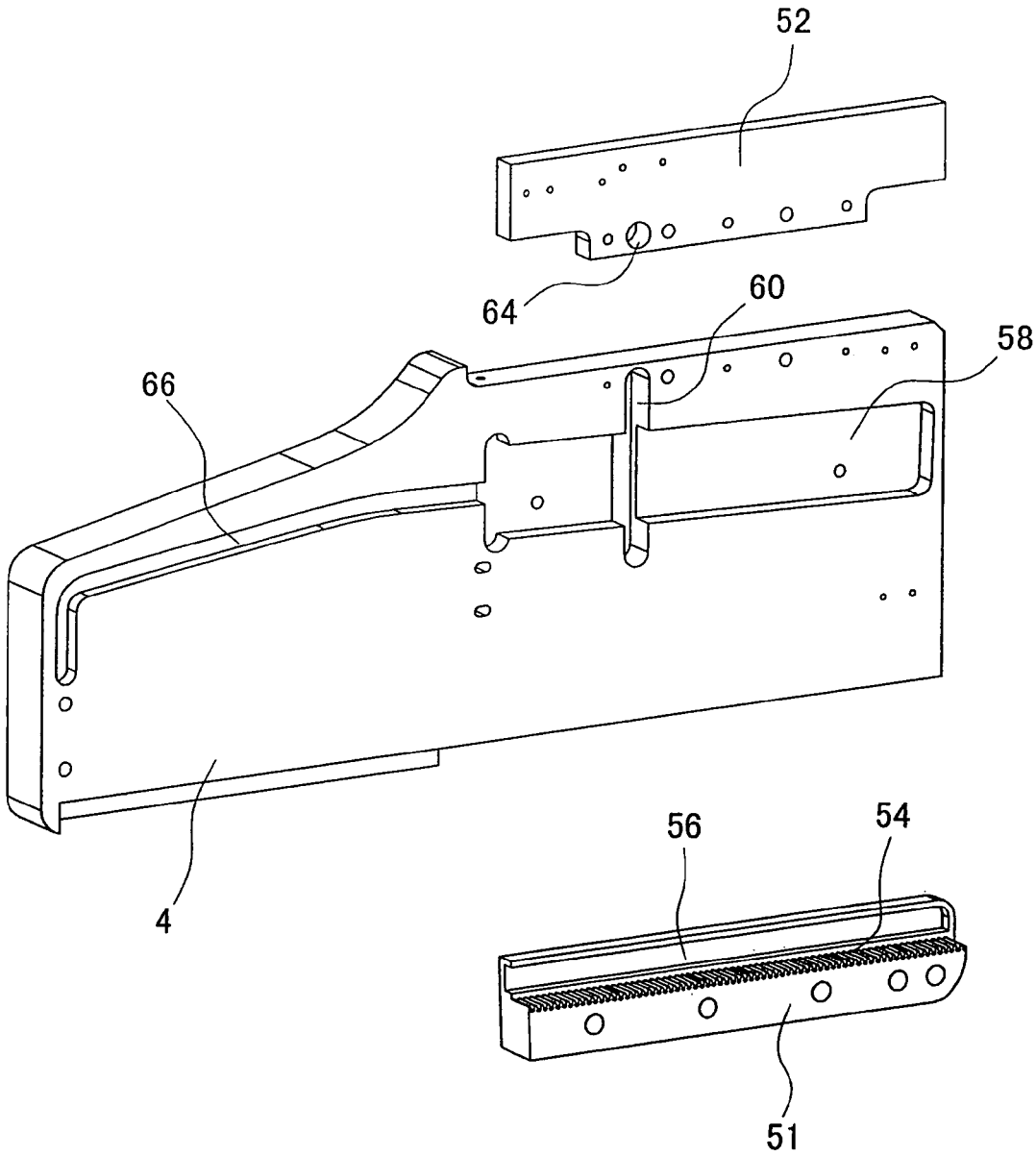
FIG. 8 is an exploded enlarged perspective view of the left arm, the rack board, and the attachment piece of the electronic keyboard musical instrument according to the embodiment.

As shown in FIGS. 7 and 8, a rack board 51 is provided with a rack tooth 54 and a guide groove 56 respectively extending in the front-to-rear direction. On the inner surface of the arm 4, an insertion groove 58 and a storing groove 60 are formed. The insertion groove 58 is formed in association with the outline of the rack board 51. The storing groove 69 is formed so as to extend across the insertion groove 58 in the up-and-down direction and to protrude from the insertion groove 58 in the up-and-down direction. The storing groove 60 is formed so as to have a depth deeper than the depth of the insertion groove 58, so that a cable 62 can be stored therein.

An attachment piece 52 is attached above the rack board 51 on the inner surface of the arm 4 in such a way that a through hole 64 formed on the attachment piece 52 overlaps with the storing groove 60. Moreover, on the inner surface of the arm 4, a guide groove 66 is also formed in the front-to-rear direction. In the present embodiment, although the guide groove 66 is also provided to the right arm 5 in the same manner as the arm 4, the storing groove 60 is not provided to the arm 5. In the present embodiment, the left and the right arms 4, 5 are symmetrically configured except for the formation of the storing groove 60.

For assembling of the arm 4, the rack board 51, and the attachment piece 52, firstly, while the cable 62 is stored in the storing groove 60, the rack board 51 is inserted into the insertion groove 58 so as to be attached to the arm 4. Then, the cable 62 is inserted through the through hole 64 of the attachment piece 52, and the attachment piece 52 is attached to the arm 4.

In the present embodiment, as shown in FIG. 1, the cable 62 is connected to a USB (Universal Serial Bus) terminal 68 disposed above the keyboard cover 8 in the front side of the body unit 1. It is to be noted that the cable 62 does not have to be connected to the USB terminal 68, but may be connected to a supplemental storage device, such as a Floppy (registered trademark) disc drive, a CD-ROM drive, and so on, which is provided to the body unit 1.

The keyboard cover 8 is configured so as to be guided by the guide grooves 56 of the rack boards 51 and the guide grooves 66 of the arms 4, 5. Moreover, the keyboard cover 8 is provided with pinion toothed wheels (not shown), which are rotatably disposed and engaged with the rack teeth 54.

When the keyboard cover 8 is moved and guided along the guide grooves 56, 66, the keyboard cover 8 is moved so as to intersect with the cable 62. Since the cable 62 is stored in the storing groove 60, the keyboard cover 8 does not interfere with the cable 62. Moreover, since the cable 62 is stored in the storing groove 60 and is not secured by an adhesion tape or the like, the keyboard cover 8 and the cable 62 do not interfere with each other even if the adhesion tape or the like is removed due to aging, temperature increase, or the like. Even though the configuration is made in such a way that the cable 62 runs outside of the rack board 51, the size of the body unit 1 does not become large, because the cable 62 is stored inside of the storing groove 60.

Figure 9:
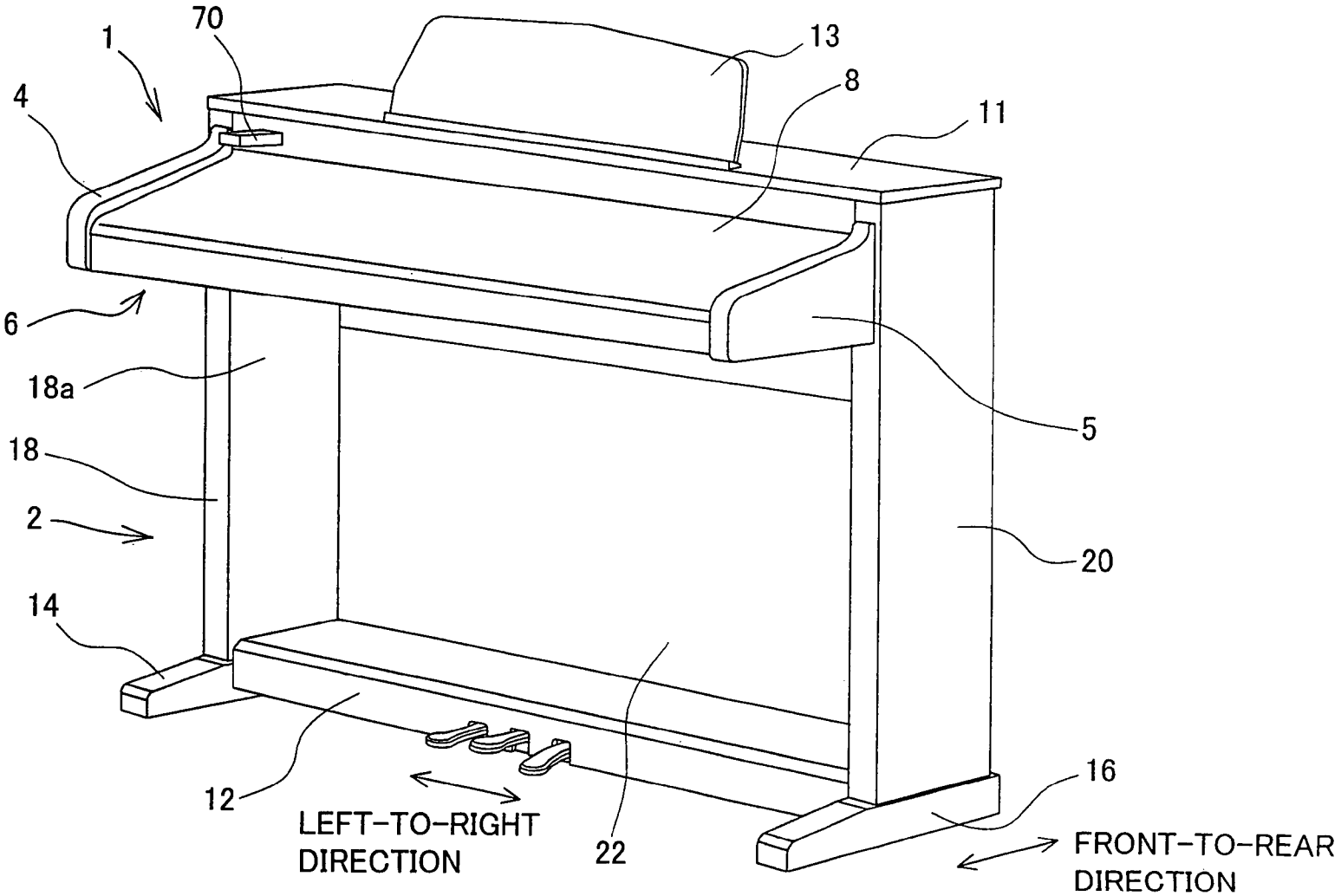
FIG. 9 is a perspective view of the electronic keyboard musical instrument according to the embodiment in a state wherein the keyboard cover is closed.

Moreover, as shown in FIG. 9, the keyboard cover 8 can be opened/closed with no difficulty while a USB memory 70 and the like is connected to the USB terminal 68. Therefore, using a USB memory 70 and the like can be convenient.

It is to be noted that the present invention is not limited to the above-described embodiment, but can be carried out in various ways without departing from the scope of the invention.

For example, although, in the above-described embodiment, guide grooves 24, 26 are provided to the side boards 18, 20 of the stand 2, and the protruding portions 30, 32, which can be inserted into the guide grooves 24, 26, are provided on the left and the right side of the body unit 1, the configuration is not limited to the above-described way. Protruding portions may be provided to the side boards 18, 20 of the stand 2, and guide grooves, which can receive the protruding portions provided to the side boards 18, 20, may be provided to the left and the right sides of the body unit 1.

Furthermore, although, in the above-described embodiment and the variations, the guide groves are disposed so as to extend in the horizontal direction, the configuration may be made such that the guide grooves are disposed so as to extend in the vertical direction, and the body unit 1 is moved in the up-and-down direction so that the guide grooves and the protruding portions respectively provided to the body unit 1 and the stand 2, or vice versa, are engaged with each other.

In addition, although, in the above-described embodiment, the projections 36 are provided on the top surfaces of the protruding portions 30, 32, the projections 36 may be alternatively disposed on, for example, the upper surfaces 24*b*, 26*b*, or the lower surfaces 24*a*, 26*a* of the guide grooves 24, 26. In this case, restriction grooves, which can receive the projections, may be formed on the surfaces facing the above-described upper surfaces 24*b*, 26*b* or the lower surfaces 24*a*, 26*a* of the protruding portions 30, 32.

Moreover, although, in the above-described embodiment, the guide grooves 24, 26 are formed such that the front ends thereof are open, the configuration of the guide grooves 24, 26 may alternatively be such that the front ends and the rear ends thereof are both open.

Additionally, the projections 36 may be formed in a button-like manner, in which the projections 36 can be depressed down to the top surfaces of the protruding portions, and, instead of restriction grooves, concave portions, which can receive the button-like projections 36 when the guide grooves provided to the body unit 1 and the protruding portions are engaged, may be formed.

Furthermore, for example, the configuration of the electronic keyboard musical instrument 3 may alternatively be as follows; guide grooves may be provided on the top and the bottom sides of the body unit 1, and protruding portions may be provided to opposed surfaces of a pair of boards, disposed so as to extend between the side boards 18, 20 in parallel to an installation surface, so that the protruding portions can be respectively engaged with the guide grooves of the body unit 1. Still furthermore, guide grooves may be provided only on the bottom side of the body unit 1, and protruding portions may be provided to the top side of a board disposed so as to extend between the side boards 18, 20 in parallel to an installation surface of musical instrument 3 so that the protruding portions can be respectively engaged with the guide grooves of the body unit 1.

Although a specific embodiment has been illustrated and described herein, it is to be understood that the above description is intended to be illustrative, and not restrictive. Combinations of the above embodiment and other embodiments will be apparent to those of skill in the art upon reviewing the above description. The scope of the invention includes any other applications in which the above structures are used. Accordingly, the scope of the invention should only be determined with reference to the appended claims, along with the full scope of equivalents to which such claims are entitled.

What is claimed is:

1. An electronic keyboard musical instrument comprising:

a body unit of the musical instrument; and a stand attached to the body unit;

the stand comprising a pair of side boards disposed in a standing manner so as to interpose the body unit therebetween, the body unit comprising a pair of lateral surfaces, each of the pair of lateral surfaces facing one of the pair of side boards and comprising a first engaging portion disposed thereon, each of the pair of side boards comprising a first engaged portion engaged by the first engaging portion and disposed on an inner lateral surface thereof, which faces one of the pair of lateral surfaces of the body unit, the first engaging portion and the first engaged portion being engaged with each other by at least one of the body unit and the stand being moved in a predetermined horizontal direction, wherein the first engaged portion is a guide groove formed so as to extend in the horizontal predetermined direction, one of the body unit and the pair of side boards is provided with projections protruding in a standing direction of the pair of side boards, and another is provided with restriction grooves adopted such that the projections are engaged therewith, each of the projections is engaged with one of the restriction grooves, when the first engaging portion is engaged with the guide groove, the first engaging portion is a protruding portion protruding from each of the pair of lateral surfaces of the body unit, each of the restriction grooves is disposed inside of the guide groove, and each of the projections is disposed on the protruding portion.

2. The electronic keyboard musical instrument according to claim 1 wherein the first engaged portion is a guide groove formed so as to extend in the predetermined horizontal direction.

3. The electronic keyboard musical instrument according to claim 2 wherein an end portion of the guide grove, from which the first engaging portion is inserted, is chamfered.

4. The electronic keyboard musical instrument according to claim 2 wherein the guide groove is formed such that one end thereof is open and another end is closed.

5. The electronic keyboard musical instrument according to claim 1, wherein the pair of side boards are disposed so as to interpose the body unit from an alignment direction of keys of a keyboard, and wherein the pair of lateral surfaces of the body unit are outer surfaces of the keyboard in the alignment direction.

6. The electronic keyboard musical instrument according to claim 1 wherein the first engaging portion is a protruding portion that protrudes from each of the lateral surfaces of the body unit.

7. The electronic keyboard musical instrument according to claim 6 wherein a chamfered portion is formed on a distal end of the protruding portion.

8. The electronic keyboard musical instrument according to claim 1, wherein the body unit comprises second engaging portions, each of the second engaging portions being engaged with one of the pair of side boards, when the first engaging portion and the first engaged portion are engaged, and wherein each of the pair of side boards comprises a second engaged portion engaged with one of the second engaging portions.

9. The electronic keyboard musical instrument according to claim 8 wherein one of the second engaging portion and the second engaged portion is a projection that protrudes in a standing direction of the pair of side boards.

10. The electronic keyboard musical instrument according to claim 9 wherein one of the second engaging portion and the second engaged portion which is not the projection is a restriction groove with which the projection is engaged.

11. The electronic keyboard musical instrument according to claim 8, wherein each of the second engaging portions is provided to the first engaging portion, and wherein the second engaged portion is provided to the first engaged portion.

12. The electronic keyboard musical instrument according to claim 1, wherein a member disposed in the body unit is secured to the first engaging portion by screws, and wherein the screws that secure the member disposed in the body unit are inserted into the protruding portions from outside of the body unit.

* * * * *